US010434023B1

(12) United States Patent
Fonarow

(10) Patent No.: US 10,434,023 B1
(45) Date of Patent: Oct. 8, 2019

(54) CAR TRANSFER ADAPTED WHEELCHAIR

(71) Applicant: Janice L. Fonarow, Columbus, OH (US)

(72) Inventor: Janice L. Fonarow, Columbus, OH (US)

( * ) Notice: Subject to any disclaimer, the term of this patent is extended or adjusted under 35 U.S.C. 154(b) by 0 days.

(21) Appl. No.: 16/182,687

(22) Filed: Nov. 7, 2018

(51) Int. Cl.
*A61G 7/10* (2006.01)

(52) U.S. Cl.
CPC ..... *A61G 7/1046* (2013.01); *A61G 7/1019* (2013.01); *A61G 7/1026* (2013.01); *A61G 7/1034* (2013.01)

(58) Field of Classification Search
None
See application file for complete search history.

(56) References Cited

U.S. PATENT DOCUMENTS 4,155,588 A * 5/1979 Danziger ..... A61G 5/00 297/115
4,278,387 A * 7/1981 Seguela ..... A61G 3/06 414/462
4,354,791 A * 10/1982 Antonellis ..... B60N 2/062 280/304.1
4,515,383 A * 5/1985 Minnebraker ..... A61G 5/08 280/250.1
5,188,383 A * 2/1993 Thompson ..... A61G 5/08 280/250.1
5,669,620 A * 9/1997 Robbins ..... A61G 3/02 280/250.1
5,884,929 A * 3/1999 Kincaid ..... A61G 3/06 280/250.1
6,361,267 B1 * 3/2002 Chuang ..... A61G 5/00 280/304.1
6,802,518 B2 * 10/2004 Kuntz ..... A61G 5/10 280/149.2
8,544,866 B2 * 10/2013 Noonan ..... A61G 5/006 280/304.1
9,839,565 B1 * 12/2017 Harris ..... A61G 5/1059
2010/0154116 A1 * 6/2010 Fan ..... A61G 5/1059 5/86.1

* cited by examiner

*Primary Examiner* — Mark C Hageman
(74) *Attorney, Agent, or Firm* — Mueller Law, LLC; Jerry K. Mueller, Jr.

(57) ABSTRACT

A wheelchair includes a removable seat assembly that slides laterally sideways to either side of the wheelchair for assisting a seated wheelchair occupant onto a receiving seat, such as a vehicle seat.

12 Claims, 5 Drawing Sheets

CAR TRANSFER ADAPTED WHEELCHAIR

CROSS-REFERENCE TO RELATED APPLICATIONS

None.

STATEMENT REGARDING FEDERALLY SPONSORED RESEARCH

Not applicable.

BACKGROUND

Conventional wheelchairs provide satisfactory performance in transporting a user within buildings and localized areas. The conventional wheelchair can be pushed by a caregiver or can be operated by a user having sufficient arm strength. Further, conventional wheelchairs can be folded to facilitate storage and transport in vehicles.

However, when the user is relatively weak and/or is unable to stand on their own, conventional wheelchairs have drawbacks. For example, the caregiver may be required to lift the user from the wheelchair and to position the user in a vehicle, a bed, or other location. This may be particularly difficult if the user is large and heavy and/or the caregiver is small and/or lacking in strength. Further, moving the user from the wheelchair to a vehicle may be difficult depending on the height and placement of the vehicle seat, and the configuration of the vehicle door. As a result, moving a user from a wheelchair to a vehicle, and vice versa, may cause stress and/or injury to the user.

Motorized wheelchairs permit the user to move about on their own, even when the user has limited strength. However, in the case of severely disabled users, a caregiver is required to lift the user from the wheelchair and to move the user to a vehicle, bed or other location, as in the case of conventional wheelchairs. Further, motorized wheelchairs are relatively expensive and require a large or specialized vehicle for transport.

Special wheelchair vehicles may include a wheelchair lift and may provide sufficient area for the user to remain in the wheelchair during travel. However, such special wheelchair vehicles are expensive and are practical primarily for hospitals, nursing homes and other institutions.

The present disclosure, then, is addressed to a modified wheelchair for transferring a person from a wheelchair into a vehicle and vice versa.

BRIEF SUMMARY

A wheelchair (10) is adapted for transfer of an occupant of the wheelchair laterally to a horizontal receiving seat (86) and includes a frame assembly. The frame assembly includes pairs of forward legs (26, 28) and rearward legs (24, 30), a pair of upper substantially parallel sidebars (32, 34), a pair of lower substantially parallel sidebars (38, 40), a pair of pivotally connected scissors bars (42, 44), one each of the pivotally connected scissors bars running from one of the substantially parallel upper sidebars to an oppositely located lower substantially parallel sidebar, and a flat plate (52) having side lips (54, 56), forward and rearward C-bars (53, 55), and a retaining receiving receptacle (82) affixed to the bottom of the flat plate (51). The wheelchair also includes a forward pair of wheel assemblies (12, 14) and two rear wheel assemblies (16, 18), both pair of wheel assemblies carried by the frame assembly, and two rear wheel locking brake assemblies (20, 22); a vertical back (66) carried by the frame assembly; and horizontal wheelchair seat assembly (46) carried by the frame assembly. The horizontal wheelchair seat assembly includes a flat plate (50) terminated by a pair of laterally extending C-bars 49 and 51 that are slidingly engaged with the frame assembly pair of laterally extending forward and rearward C-bars (53, 55) and a cushion (48) carried by the flat plate (50), wherein the horizontal wheelchair seat assembly is extendable laterally sideways to meet the horizontal receiving seat. Finally, the wheelchair includes a removable actuatable lifting assembly (68) matable with the retaining receiving receptacle for lifting the horizontal wheelchair seat assembly, and a pair of lateral side, downwardly foldable armrests (58, 60).

BRIEF DESCRIPTION OF THE DRAWINGS

For a fuller understanding of the nature and advantages of the present method and process, reference should be had to the following detailed description taken in connection with the accompanying drawings, in which.

The drawings will be described in greater detail below.

DETAILED DESCRIPTION

Figure 1:
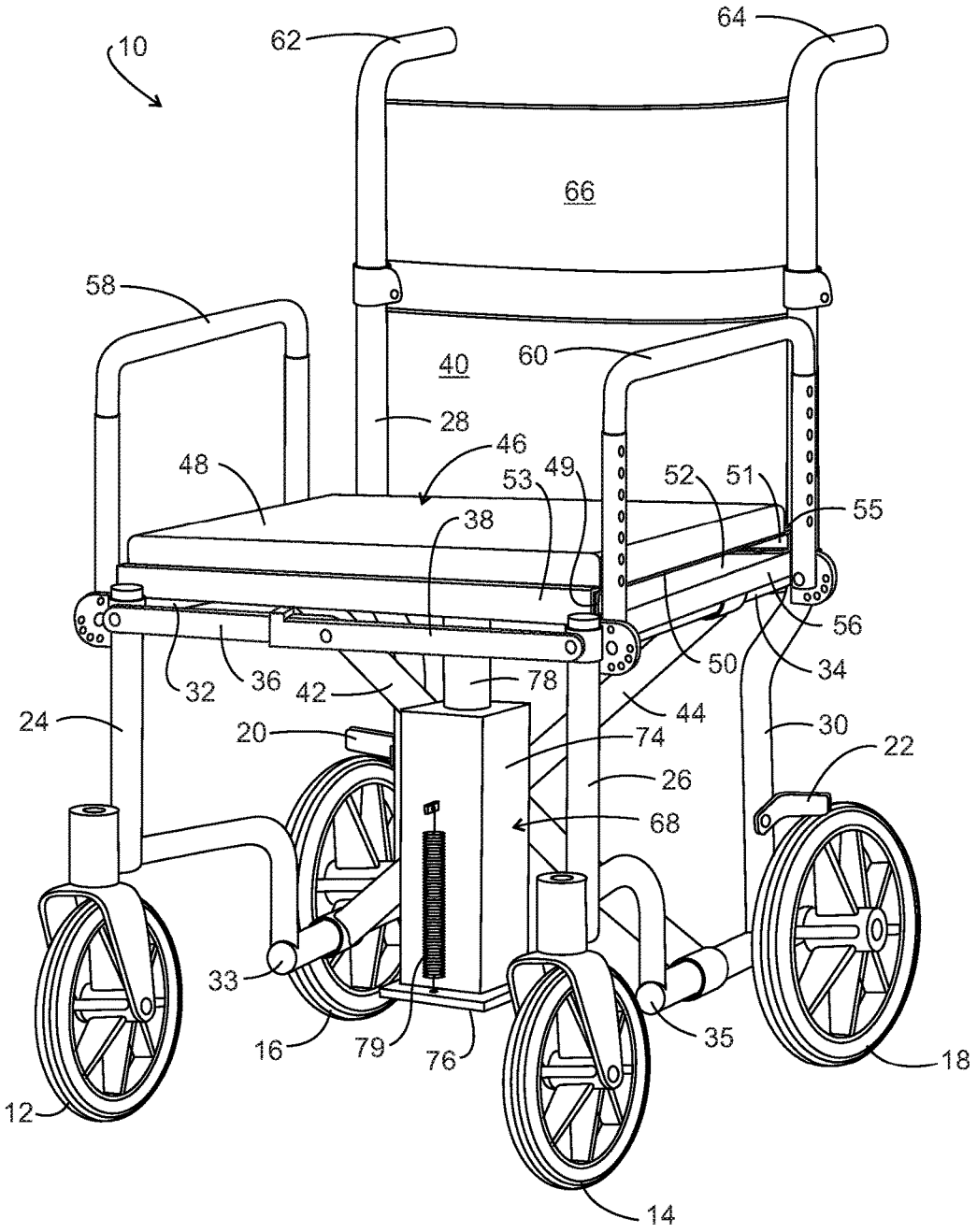
FIG. 1 is an isometric view of the disclosed wheelchair in its home position.
Figure 5:
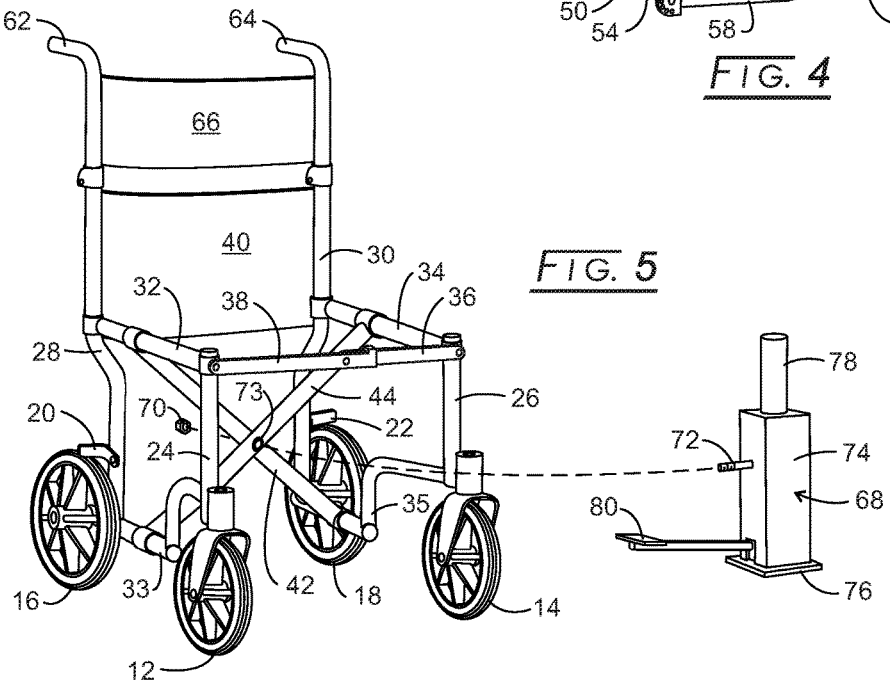
FIG. 5 is an isometric view of the wheelchair of FIG. 3 showing the lift assembly and its installation onto the wheelchair.

Referring initially to FIG. 1, a disclosed wheelchair, 10, is shown. In conventional fashion, wheelchair 10 is fitted with 2 front caster wheel assemblies, 12 and 14, and two rear wheel assemblies, 16, and 18, which rear wheels are lockable with foot pedals, 20 and 22, in conventional fashion. The 4 wheel assemblies are fitted to a frame assembly, which may be easier to see in FIGS. 3 and 5. The frame assembly includes 4 upstanding legs, 24, 26, 28, and 30, to which the wheel assemblies, respectively, are attached. Upstanding legs, 24, 26, 28, and 30 can be telescoping. In turn, the 4 upstanding legs are attached to a pair of substantially parallel sliding bars, 32 and 34, and are fixed to a pair of bars 33 and 35 at their bottoms. The front sliding ends of bars 32 and 34 are pivoted to a front lateral foldable assembly consisting of a pair of forward lateral bars, 36 and 38. Forward lateral bars 36 and 38 are pivotally connected with bar 38 containing a reward locking projection that results in bar 38 being pushed down upon bar 36, locking the bars 24 and 26 a fixed distance apart. The rear backrest 40 connects the two rear bars 28 and 30. The backrest 40 is made of a flexible fabric that folds, along with bars 36 and 38, locking the bars 28 and 30 a fixed distance apart. The frame assembly is completed with a pair of pivotally connected scissors bars, 42 and 44, that span, respectively, between bar pairs 32/35 and 34/33. Wheelchair 10 is foldable by lifting up on forward lateral bar 38 while pivoting with forward lateral bar 36.

Figure 2:
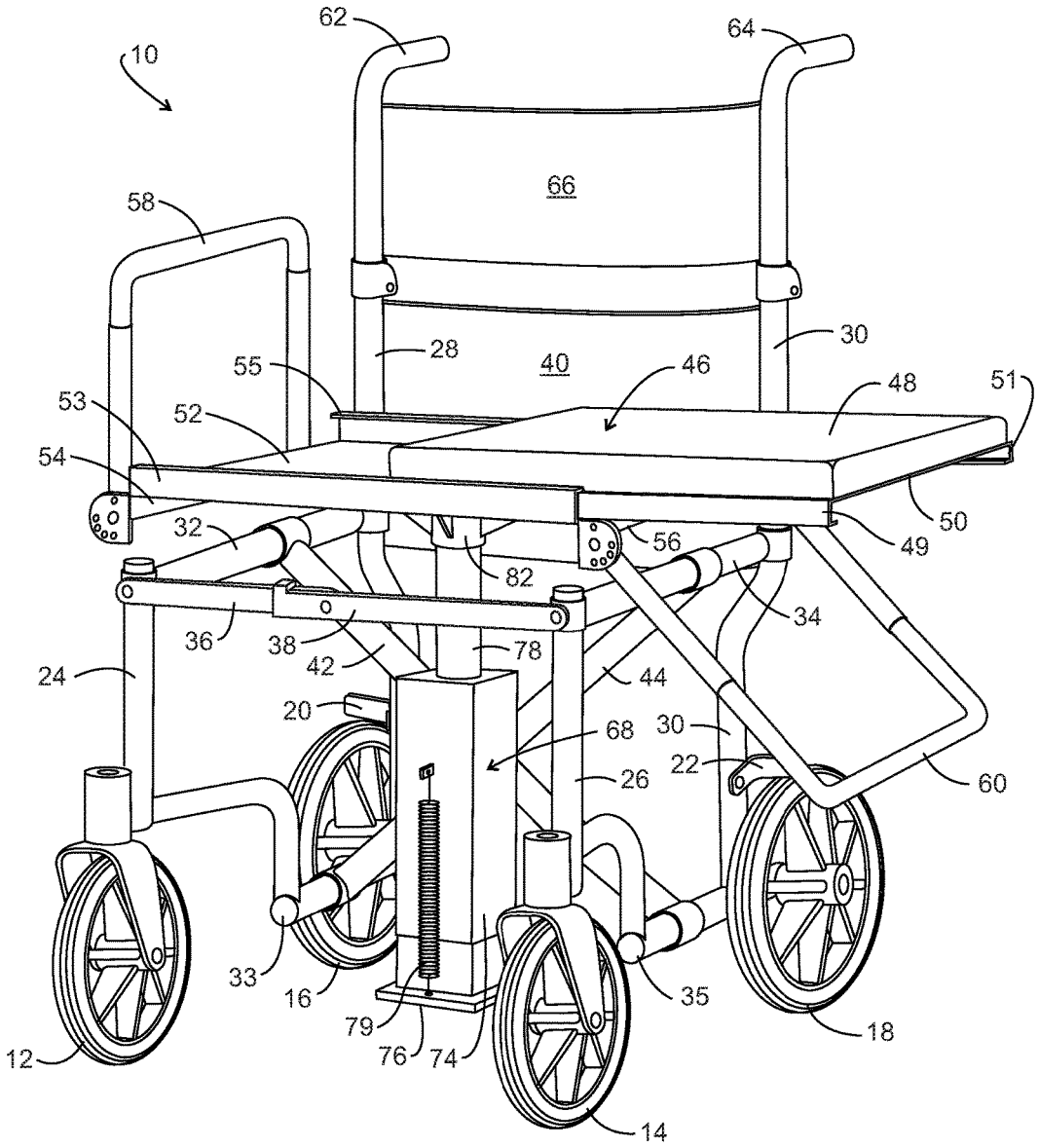
FIG. 2 is an isometric view of the disclosed wheelchair in its vehicle transfer position.
Figure 3:
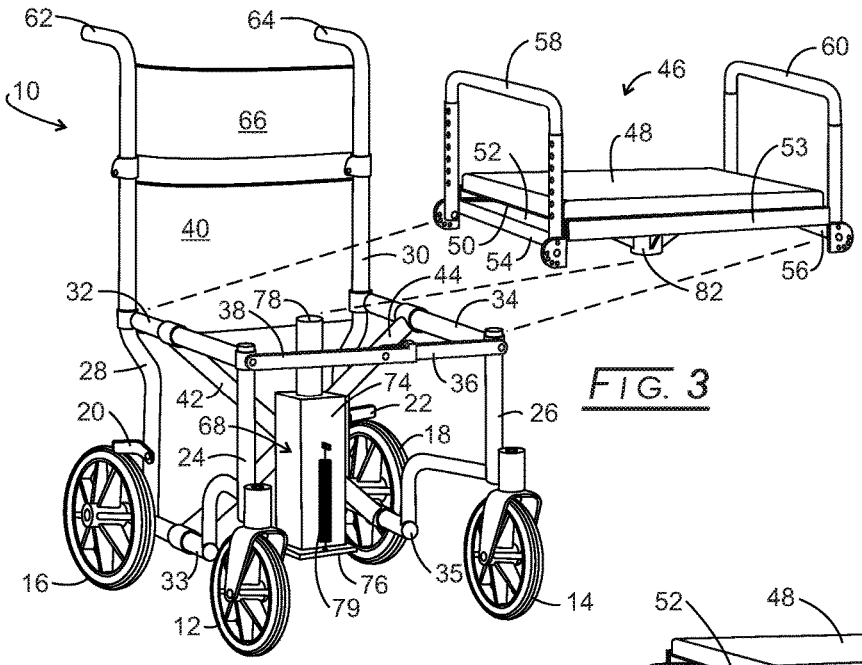
FIG. 3 is an isometric view of an alternative wheelchair embodiment with removable seat assembly.
Figure 7:
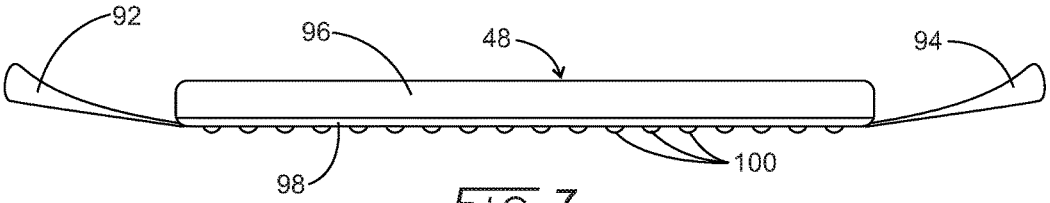
FIG. 7 is a side view of seat cushion movable from the wheelchair into a vehicle seat and vice versa.
Figure 8:
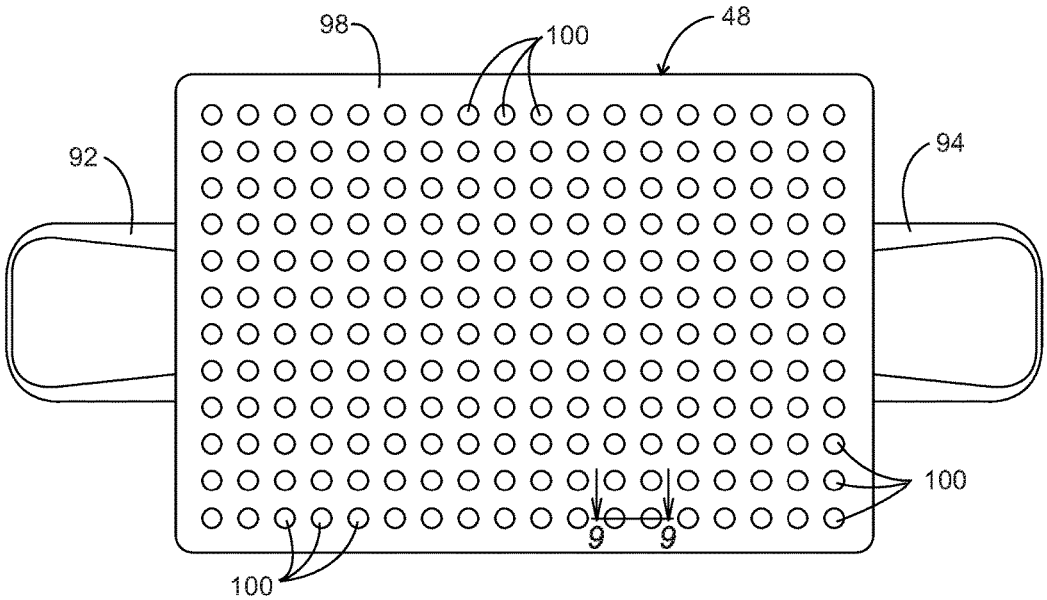
FIG. 8 is a bottom view of the seat cushion shown in FIG. 7.
Figure 9:
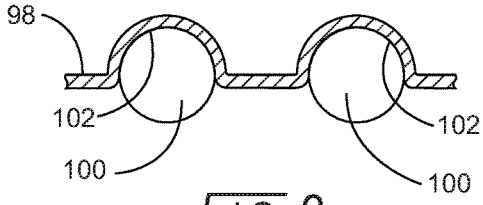
FIG. 9 is a sectional view taken along line 9-9 of FIG. 8.

A seat assembly, 46, rests upon bars 32 and 34 in it home position. Note, that there is no lateral rear bar nor is it needed due to the rear backrest 40. Referring now also to FIGS. 2 and 3, the details of seat assembly 46 will be revealed. Initially, it will be noted that seat assembly 46 is removable form wheelchair 10, as is best seen in FIG. 3. Such removability enables wheelchair 10 to be foldable, as explained above. Seat assembly 46 includes a foam seat cushion, 48, for the comfort of the user. Seat cushion 48 rests atop a support assembly that includes a rigid plate assembly, 50. Rigid plate assembly 50, in turn, slides within plate, 52, terminated by a pair of laterally extending C-bars 49 and 51, which slidingly engage a pair of laterally extending forward and rearward C-bars, 53 and 55, of plate 50. Such sliding engagement could be augmented by use of rollers, ball bearings, or other friction reducing arrangement, as illustrated in FIGS. 7-9, described below. Even lining the surfaces of one or both of C-bars 53/55 and/or 49/51 with nylon or other friction reducing material could promote extension of seat assembly 46.

Figure 4:
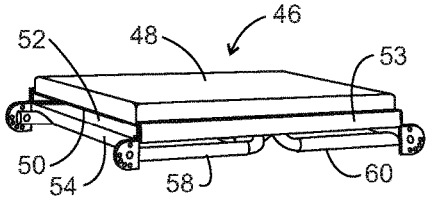
FIG. 4 is an isometric view of the removable seat assembly of FIG. 3 with arms folded underneath the seat.

The outwardly extending edges of flat plate 52 are terminated with slightly downwardly extending lips, 54 and 56, that keep seat assembly 46 from unintended sliding laterally sideways in its home position. Seat assembly 46 additionally includes a pair of armrests/handles, 58 and 60. Armrests/handles 58 and 60 are foldable downwardly, as best seen in FIGS. 2 and 4. A variety of connections can permit such folding action. In the drawings, the connection is a tab containing a series of apertures through which a biased pin fits. By pressing in the biased pin, the arms can be adjusted. Armrests/handles 58 and 60 additionally are adjustable upwardly/downwardly by a similar aperture/biased pin assembly as permits them to be folded. Again, a variety of other such assemblies could be used for such height adjustment. As illustrated in FIG. 3, seat assembly may be lifted from wheelchair 10 for folding of wheelchair 10. In fact, folding of armrests/handles 58 and 60 underneath seat assembly 46 makes its storage, such as for travel, quite accommodating, as is illustrated in FIG. 4.

Completing the description of wheelchair 10, two upstanding handle assemblies, 62 and 64, are attached to the rear ends of bars 28 and 30, respectively. Again, upstanding handle assemblies 62 and 64 are foldable and could be adjustable upwardly/downwardly to accommodate the different heights of those pushing wheelchair 10. A fabric back, 66, stretches between upstanding handle assemblies 62 and 64 to support the back of the user and together form a back assembly for wheelchair 10. The upper ends of upstanding handle assemblies 62 and 64 could be fitted with grips, as is customary for wheelchairs. Such grips, along with footrests, and other optional items often found on current models of wheelchairs are not shown in the drawings, and can be provided as is necessary, desirable, or convenient.

Seat assembly 46 has an additional feature that will facilitate the ingress and egress of users to and from vehicle seats. Reference now is made to FIGS. 2 and 3 that illustrate such additional feature. Initially, transfer of the wheelchair user can be made to both sides of wheelchair 10; although, only one direction is illustrated in the drawings in the direction of armrest/handle 60 with transfer in the direction of armrest/handle 58 proceeds correspondingly similarly.

Transfer of a user to a vehicle will rely on a lifting assembly, 68, for raising seat assembly 46. While a variety of lifting assemblies can be contemplated and will find good use herein, the drawings show a lifting assembly, 68, that can affixed at the pivot of pivotally connected scissors bars 42/44 using a nut, 70, or similar hand tightenable hardware that conveniently screws only a threaded pin, 72, extending from lifting assembly 68 and adapted to penetrate an aperture, 73, at the scissors assembly pivot. Lifting assembly 68 consists of an external container, 74 and inner rod and piston assembly 78, having a bottom foot, 76. Rod and piston assembly 78 slide within external container, 74 and is biased upwardly by spring, 79, holding the lifting assembly, 68, off the ground surface when transporting a user. A foot pedal, 80, extends from lifting assembly below threaded pin 72 and is accessible by the caregiver for raising lifting assembly 68. The extending rod extending from the extending rod extending from inner rod and piston assembly 78 fits into a retaining receiving receptacle, 82 (see FIG. 3), attached to the bottom of flat plate 52 of seat assembly 46. The aperture in retaining receiving receptacle 82 is of sufficient depth to satisfactorily retain the extending rod extending from inner rod and piston assembly 78 for support of seat assembly 46 and a user seated thereupon for transfer to/from a vehicle seat.

Figure 6:
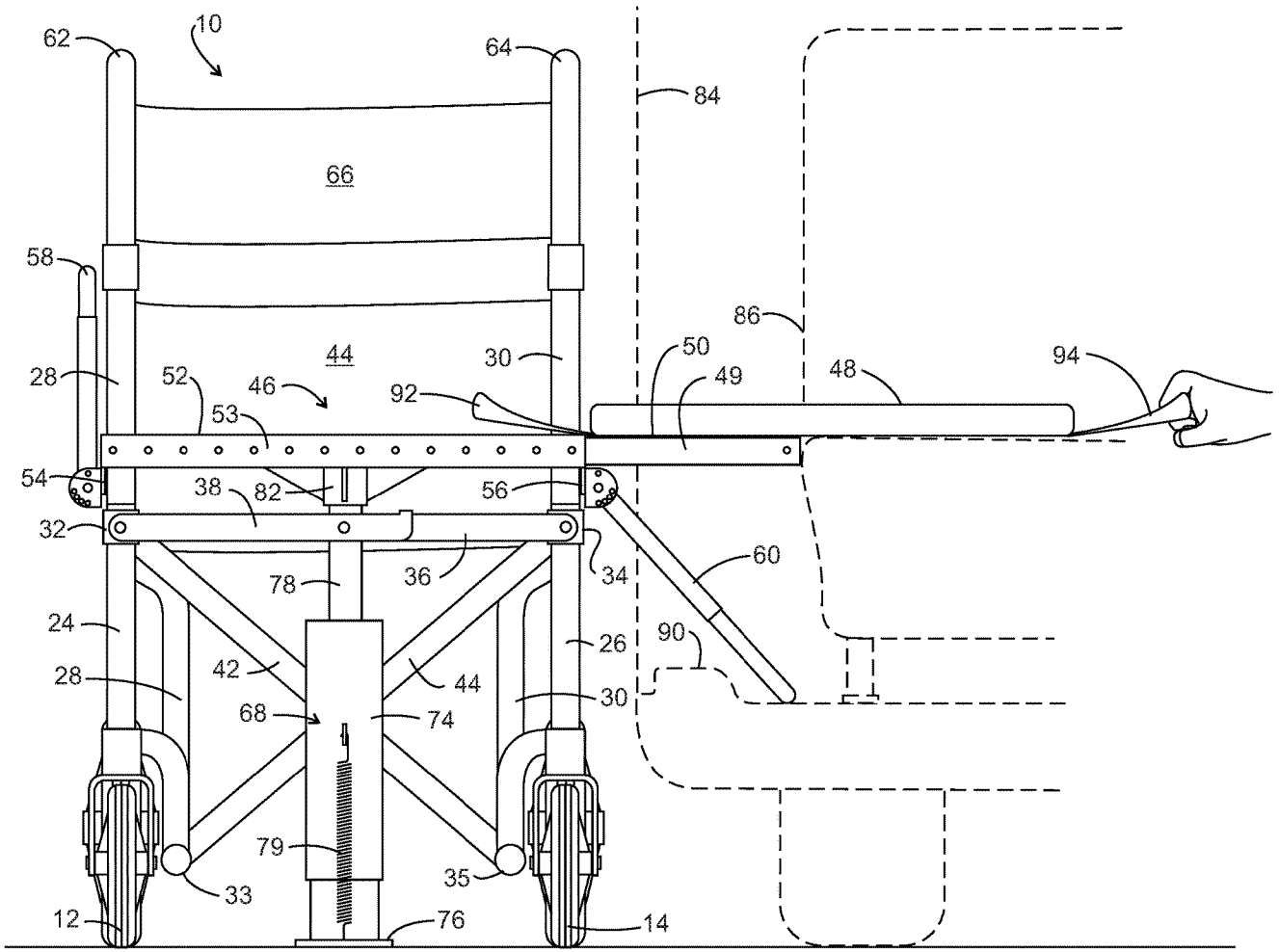
FIG. 6 is an isometric view of the disclosed wheelchair adjacent a vehicle and in an occupant transfer position.

For vehicle transfer, wheelchair 10 is moved adjacent to the open car door location where the destination vehicle seat is located. FIG. 6 is best viewed along with FIG. 2 for the transfer procedure where a vehicle, 84, and seat, 86, are shown in phantom. While it is best for wheelchair 10 to be stationed parallel to the car, this is not necessary as will be appreciated as the description unfolds below. Initially, foot pedal 80 is pumped to extend the rod of rod and piston assembly, 78. The foot of lifting assembly, 68, is lowered to the ground surface thus raising seat assembly 46 sufficient high that the user seated upon cushion 48 is raised to a level just higher than seat 86. Armrest/handle 60 is moved downwardly, as shown in FIG. 2, and into the well between seat 86 and a rocker panel, 90, of vehicle 84. Now armrest/handle 60 may need to be extended to move into this position for ensuring that wheelchair 10 does not unintendingly move away from vehicle 84. Seat assembly 46 is moved laterally in the direction of vehicle 84 and seat 86, and foot pedal brakes 20/22 are set. It should be appreciated that seat assembly 46 is permitted to rotate a bit on the rod of rod and piston assembly 78 since there is nothing prohibiting such rotation. Such slight rotation may be needed should wheelchair 10 not be sufficiently parallel to vehicle 84 in order to facilitate the transfer. Flat plate 52 is lifted up, moving lips, 54 and 56, upwardly clearing bars, 32 and 34, in order that it can move over and extend laterally, as illustrated in FIG. 2.

As will be seen in FIG. 6, seat assembly 46 is moved laterally until C-bars 49 and 51 butt up against seat 86 whereupon the user can be transferred into seat 86. For somewhat mobile users, the user may be able to scoot onto/out of seat 86. For non-mobile users, assistance may be required to scoot the user onto/out of seat 86. For that purpose, each side of seat cushion 48 of seat assembly 46 has a strap, 92 and 94, for an attendant/caregiver to hand grasp and pull both the seat cushion and seated occupant onto car seat 86 and back again from car seat 86 onto wheel chair 10, as needed. Of course, wheelchair 10 would need to be locked for safety and lifting assembly 68 raised into an appropriate height depending upon whether the wheelchair occupant is being moved off of or onto wheelchair 10. To facilitate movement of seat cushion 48 onto the car seat, the bottom of seat cushion 48 could be made from and/or coated a friction-reducing (plastic) material. In fact, rollers, ball bearings, or other friction reduction arrangements could be affixed to the bottom of seat cushion 48.

Following transfer of the wheelchair occupant into vehicle 84, as shown in FIG. 6, seat assembly 46, less seat cushion 48, then, can be moved back into its home position. If wheelchair 10 is to be put into vehicle 84, the caregiver need only disengage rod and piston assembly 78, which as illustrated operates much like a barber chair where lifting up on foot pedal 80 releases the assembly to its home position. Wheelchair 10 can be folded with lifting assembly 68 in position, or lifting assembly 68 can be removed before wheelchair 10 is folded up. The illustrated embodiment is sufficiently flexible in operation to permit both versions of folding.

As stated earlier, sliding engagement of seat cushion 48 onto vehicle seat 86 could be augmented by use of rollers, ball bearings, or other friction reducing arrangement. One such embodiment is illustrated in FIGS. 7-9. In particular, foam seat cushion 48 rests atop a rigid plate, 98, which can be made of virtually any material, but a "slippery" polymeric material is preferred in order to aid sliding of seat cushion 48 onto vehicle seat 86. In the illustrated embodiment rigid plate 98 retains a plurality of rollers or ball bearings, 100, which can be small in size so as to protrude only slightly therefrom in order to not cause any damage to vehicle seat 86. The number and location of such ball bearings 100 is within the skill of the wheelchair designer and manufacturer. Ball bearings 100 make it easier for a caregiver to pull on strap 92 or strap 94 to move seat cushion 48 across vehicle seat 86 with the weight of a person seated upon seat cushion 48. Of course, wheels or other roller assembly designs could be used in the same manner as ball bearings 100 described and illustrated herein.

While the apparatus, system, and method have been described with reference to various embodiments, those skilled in the art will understand that various changes may be made and equivalents may be substituted for elements thereof without departing from the scope and essence of the disclosure. In addition, many modifications may be made to adapt a particular situation or material in accordance with the teachings of the disclosure without departing from the essential scope thereof. Therefore, it is intended that the disclosure not be limited to the particular embodiments disclosed, but that the disclosure will include all embodiments falling within the scope of the appended claims. Also, all citations referred herein are expressly incorporated herein by reference.

I claim:

1. A wheelchair (10) adapted for transfer of an occupant of the wheelchair laterally to a horizontal receiving seat (86), which comprises:

(a) a frame assembly comprising:
- (i) pairs of forward legs (26, 28) and rearward legs (24, 30),
- (ii) a pair of upper substantially parallel sidebars (32, 34),
- (iii) a pair of lower substantially parallel sidebars (38, 40),
- (iv) a pair of pivotally connected scissors bars (42, 44), one each of the pivotally connected scissors bars running from one of the substantially parallel upper sidebars to an oppositely located lower substantially parallel sidebar, and
- (v) a flat plate (52) having side lips (54, 56), forward and rearward C-bars (53, 55), and a retaining receiving receptacle (82) affixed to the bottom of the flat plate (51);

(b) a forward pair of wheel assemblies (12, 14) and two rear wheel assemblies (16, 18), both pair of wheel assemblies carried by the frame assembly, and two rear wheel locking brake assemblies (20, 22);

(c) a vertical back (66) carried by the frame assembly;

(d) horizontal wheelchair seat assembly (46) carried by the frame assembly and comprising:
- (i) a flat plate (50) terminated by a pair of laterally extending C-bars (49, 51) that are slidingly engaged with the frame assembly pair of laterally extending forward and rearward C-bars (53, 55); and
- (ii) a cushion (48) carried by the flat plate (50), wherein the horizontal wheelchair seat assembly is extendable laterally sideways to meet the horizontal receiving seat;

(e) a removable actuatable lifting assembly (68) matable with the retaining receiving receptacle for lifting the horizontal wheelchair seat assembly; and (f) a pair of lateral side, downwardly foldable armrests (58, 60).

2. The wheelchair of claim 1, wherein the forward pair of wheel assemblies are caster wheels (12, 14).

3. The wheelchair of claim 1, wherein the pair of lateral side, downwardly foldable armrests (58, 60) are vertically adjustable.

4. The wheelchair of claim 1, additionally comprising a pair of upstanding handle assemblies (62, 64) attached to the frame assembly for pushing of the wheelchair.

5. The wheelchair of claim 4, wherein the vertical back is located between the pair of upstanding handle assemblies (62, 64).

6. The wheelchair of claim 4, wherein the foldable armrests (58, 60) are lateral side downwardly foldable to engage a vehicle rocker panel.

7. The wheelchair of claim 1, wherein the horizontal wheelchair seat assembly is removable and the frame is foldable.

8. The wheelchair of claim 1, wherein the cushion has handles (92, 94) affixed thereto for moving the cushion from and onto the seat assembly.

9. The wheelchair of claim 1, wherein the cushion rigid plate retains a plurality of roller assemblies.

10. Method for transferring of an occupant seated on a wheelchair laterally to a horizontal vehicle receiving seat (86) of a vehicle having rocker panels (90), which comprises the steps of:
- (i) providing the wheelchair of claim 1;
- (ii) moving the wheelchair adjacent to the horizontal vehicle receiving seat;
- (iii) locking the rearward pair of locking brake assemblies;
- (iv) raising the actuatable lifting assembly to raise the seat assembly;
- (v) folding the foldable armrest adjacent to the vehicle receiving seat downwardly to engage the vehicle rocker panel;
- (vi) extending the seat cushion laterally towards the vehicle receiving seat onto the vehicle seat.

11. The method of claim 10, wherein a handle is grasped and pulled for the laterally extending of the seat cushion.

12. The method of claim 10, wherein the cushion rigid plate retains a plurality of roller assemblies to facilitate the extending of the seat cushion laterally towards the vehicle receiving seat.

* * * * *